US005152429A

United States Patent [19]

Billings

[11] Patent Number: 5,152,429

[45] Date of Patent: Oct. 6, 1992

[54] BEVERAGE DISPENSER UNIT

[76] Inventor: Chris L. Billings, 3458 Knoxville Ave., Long Beach, Calif. 90808

[21] Appl. No.: 680,159

[22] Filed: Apr. 3, 1991

[51] Int. Cl.[5] ..... B67D 5/56

[52] U.S. Cl. ..... 222/129.2; 222/129.4; 222/144.5

[58] Field of Search ..... 222/129.1-129.4, 222/144.5

[56] References Cited

U.S. PATENT DOCUMENTS

| | | | |
|---|---|---|---|
| 3,940,019 | 2/1976 | Kross et al. | 222/129.2 X |
| 3,979,023 | 9/1976 | Hartley | 222/144.5 X |
| 4,042,151 | 8/1977 | Uttech | 222/129.2 |
| 4,356,937 | 11/1982 | Simon et al. | 222/129.2 |
| 4,795,061 | 1/1989 | Peckjian | 222/129.2 X |
| 5,056,686 | 10/1991 | Jarrett | 222/129.2 |

FOREIGN PATENT DOCUMENTS

| | | | |
|---|---|---|---|
| 2750377 | 5/1978 | Fed. Rep. of Germany | 222/129.1 |

*Primary Examiner*—D. Glenn Dayoan

*Attorney, Agent, or Firm*—M. Ralph Shaffer

[57] ABSTRACT

A beverage dispenser unit constructed for coupling to a water feed conduit as well as a series of intake conduit leading to respective beverage containers, for processing and delivering the beverages, with water mixture, to a desired point. The dispenser unit includes a rectangular metal cabinet provided with a lid and having interiorly thereof a series of hydraulically driven pumps, driven by the pressure of the water feed line and constructed to draw into and deliver to the hand-held mixer/dispenser for juices or other beverages desired. A manifold is included which has both beverage and water lines connected to respective outlets of the individual pumps. Essentially, the pumps, conduit, and water connection, together with the dispenser system, are all contained within the metal rectangular cabinet of the unit, the latter being provided with an exterior nozzle retainer constructed for receiving the nozzle of the dispenser. An adjustable pressure regulator is provided for regulating the pressure of the water feed delivered to the respective pumps.

5 Claims, 2 Drawing Sheets

BEVERAGE DISPENSER UNIT

FIELD OF INVENTION

The present invention relates to beverage dispenser systems, and more particularly, provides a beverage dispenser unit which includes the requisite hydraulically driven pumps, conduit, adjustable regulator and other equipment for providing a useful unit to deliver, at a hand-held mixer dispenser, any one of several beverages with appropriate water mixture thereat. The water intake is provided not only to operate the several hydraulic pumps connected to external beverage units, but also provides a water supply for mixture at the hand-held mixer dispenser portion of the unit.

BACKGROUND AND BRIEF DESCRIPTION OF PRIOR ART

In the past, beverage dispenser units have been quite cumbersome, generally requiring electrical connections and having a series of operative units disposed at various locations.

No patent literature is currently known which bears directly upon the invention described in detail herein.

One purpose of the invention is to provide all the requisite structure needed in a single unit, and with an adjustable regulator being provided as well as a series of hydraulically driven pumps, the latter being driven by the intake water line pressure and also supplying the water passing therethrough to the manifold of the unit. The concept of including a series of water-driven pumps within a cabinet, the additional structure, and the method of operation of the unit, are deemed new.

BRIEF DESCRIPTION OF INVENTION

In the present invention, a cabinet is provided that is preferably made of metal and is rectangular in shape. A lid is provided for sealing off the cabinet. Contained within the cabinet and mounted to interior portions thereof are a series of hydraulic pumps, each having a pair of lines transporting, respectively, both beverage and water to a manifold mounted within the unit. A metal flex hose is coupled from the manifold to a hand-held mixer dispenser provided with suitable finger touch controls and also a dispensing nozzle. The unit likewise includes a nozzle retainer for releasably receiving the nozzle when the same is not directly in use. A manually adjustable pressure regulator is provided in the unit, is coupled to the intake water line, and delivers water under selected pressure to the several hydraulic pumps employed. The water line thus supplies both driving pressure to the pumps and also a water supply to the manifold for selective mixing with the various juices or other beverages directed thereat and coupled by other intake conduit, via the pumps, to beverage or beverage concentrate containers stored outside of the unit.

OBJECTS

Accordingly, a principal object of the present invention is to provide a beverage dispensing unit.

A further object is to provide a new type of beverage dispenser unit having included therein a series of pumps for accommodating the reception and transport of various liquids to dispenser apparatus, the water supply of the unit serving both to drive the pumps under selected pressure, and likewise to provide a water supply to the manifold of the unit for respective mixture with individual beverages pumped into the unit from the exterior.

An additional object is to provide a dispenser unit which can easily rest upon a countertop or shelf at a store or restaurant, for example, this without requirement of electrical connection, but merely a coupling to an external pressurized water supply.

A further object is to provide a dispensing unit including all of the apparatus needed for delivering and mixing the juices or other beverages of exteriorly positioned beverage supply, and this in the desired manner by use of a handheld mixer dispenser structure.

BRIEF DESCRIPTION OF THE DRAWINGS

The present invention, together with further objects and advantages thereof, may best be understood by reference to the following description, taken in conjunction with the drawings in which.

DETAILED DESCRIPTION OF PREFERRED EMBODIMENT

Figure 1:
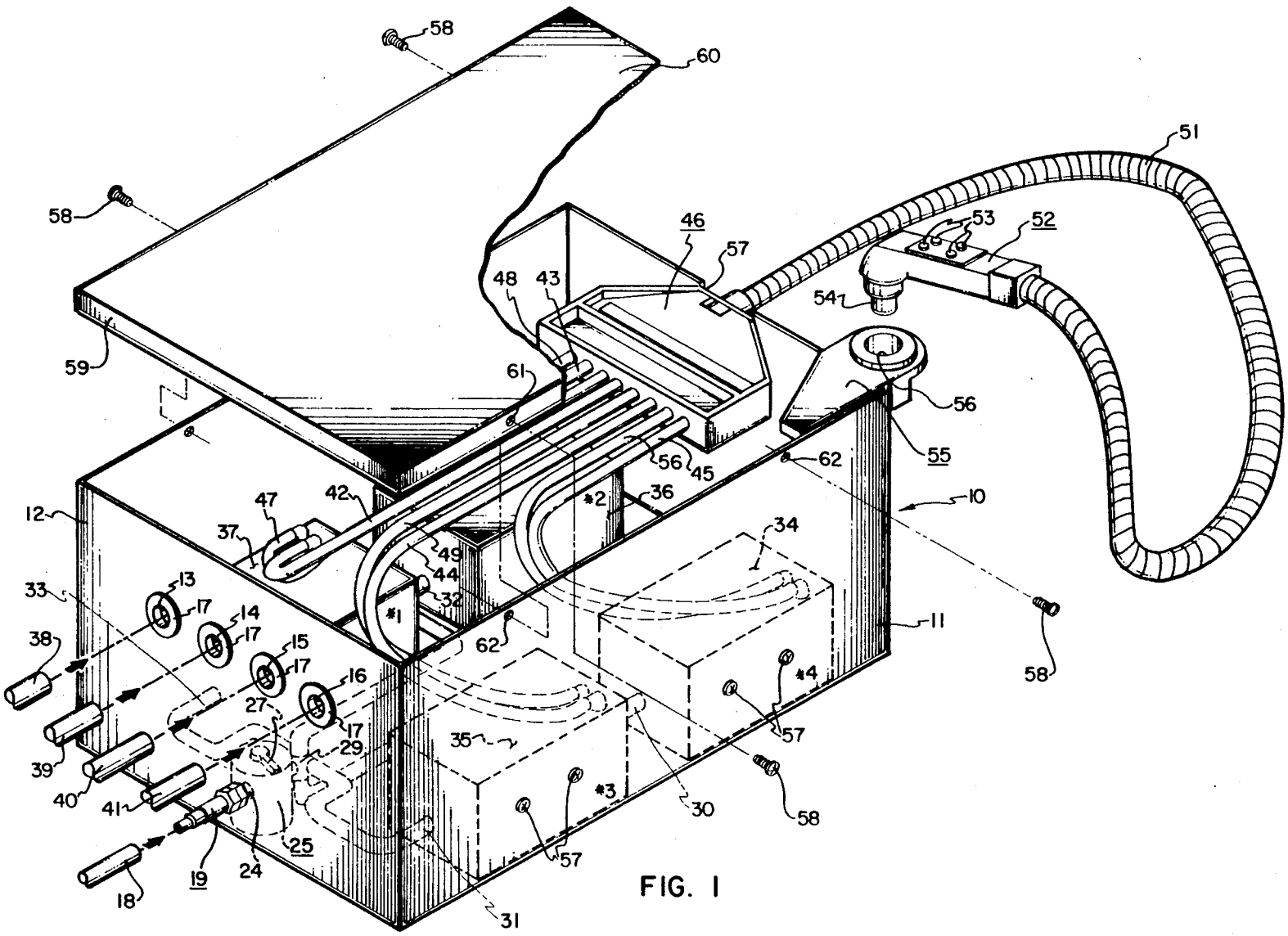
FIG. 1 is a perspective view, partially exploded, of a beverage dispenser unit constructed in accordance with the principles of the present invention
Figure 3:
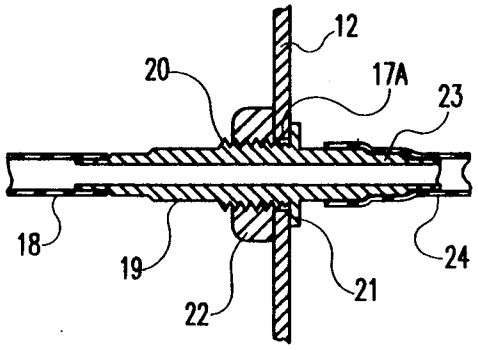
FIG. 3 is an enlarged fragmentary detail, principally in section, and illustrating the structure whereby an external water supply can be coupled to the unit.
Figure 2:
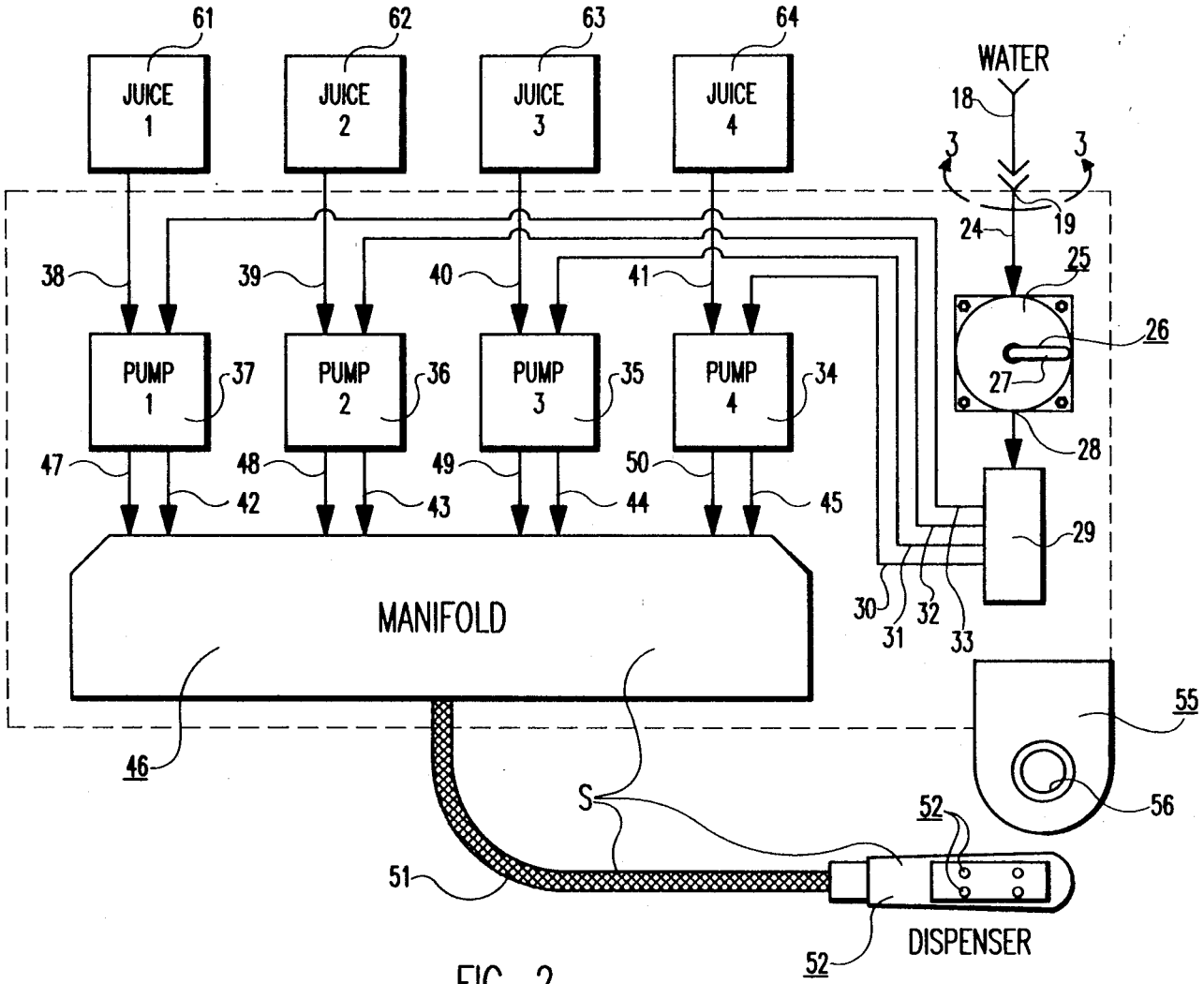
FIG. 2 is a diagram of the hydraulic system of the unit, illustrating the manner by juices or other beverages are drawn into the hydraulic pumps provided in the unit, and wherein water under pressure is also supplied and also pressure regulated such as to supply water not only to drive the various pumps but also to provide a water supply at the manifold preparatory to the mixing function.

In FIG. 1, the beverage dispenser unit 10 is shown to include an enclosure or cabinet 11, generally made of metal, and having opposite sides and opposite ends together with a bottom as indicated. The rear end or rear panel 12 includes a series of apertures, four apertures 13–16, these being provided with respective grommets 17, for the receipt of intake conduit 38–41 leading from external beverage or concentrate containers, and also an aperture 17A for receiving a pressured water connection. This is seen in FIG. 3. Referring to FIG. 3, the intake water conduit 18 is pressed onto a step connector 19 that is threaded at 20 and includes a flange 21; FIG. 3 is thus a detail of the physical structure taken along the arcuate line 3—3 in FIG. 2. Nut 22 is threaded onto the threaded portion at 20 for retaining the connector in position and tightly secured to rear panel or end 12 of the rectangular metal cabinet. Portion 23 is provided and receives conduit 24 leading to pressure regulator 25. Pressure regulator 25 includes an adjustable control 26 which is manually adjustable and includes the handle 27 indicated. The output side of the pressure regulator at 28 leads to a four-way connection at 29 for providing water via conduit 30–33 to several hydraulic pumps 34–37. Conduit 38, 39, 40 and 41 lead from the respective juice or other beverage units 1–4 in FIG. 2 directly to the pumped-fluid inlets of their corresponding pumps 37, 36, 35 and 34, respectively. Thus, the pressured water serving as the driving fluid for each of the pumps 1–4 comes from outlets of the respective pumps 1–4, being conducted by respective conduit 42–45 to manifold 46, whereas the pumped liquid, i.e. juice, concentrate, or other beverage, is conducted from the "juice" units 1–4 via respective conduit 38–41, and passes as pumped liquid through the respective pumps 37, 36, 35 and 34 to be conducted by conduit 47–50 to manifold 46.

Pumps 1–4, designated by lead lines 61–64, are standard, off-the-shelf items and may comprise what are known in the industry as Shur-flo Brix pumps, each having a pair of inlets and a pair of outlets, a respective inlet and outlet being for the drive or pumping liquid, with the remaining inlet and outlet being for the pumped liquid. Manifold 46, in combination with metal flex hose 51, hand-held finger manipulated dispenser 52 with control buttons 53, and nozzle 54, comprises a standard dispenser system or structure 5 such as that known in the industry as the Wunder-Bar dispenser system, as manufactured, for example, by the Automatic Bar Controls, Inc. Cut-outs, such as that shown at 57, are provided cabinets 11 for the manifold 46 and nozzle retainer 55, the latter provided with nozzle receiving aperture 56; thus, the manifold and nozzle retainer can be flush mounted by screws, not shown, to the cabinet 11. Aperture 56 of the nozzle retainer releasably receives the nozzle 54 when not in use.

Screws 57 are provided for securing the individual hydraulic pumps to the inner opposite sides of the rectangular metal cabinet 11, as may be appropriate. Correspondingly, additional screws 58 provided for securing the lip 59 of lid 60 over the rectangular cabinet at representative apertures 61, 62 as provided. The juice or beverage containers #1–4 in FIG. 2, identified by numerals 61–64, are coupled, of course, to the beverage conduit 38–41 as shown.

In operation, the water supply is turned on and the pressure for pump drive regulated at pressure regulator 25. Actuation of the several pumps and selection of the various beverages can be effected by hand-held mixer dispenser 52, this for delivering the desired liquid or liquid mix at nozzle 54. When the unit is inoperative, then the nozzle 54 is simply replaced into the nozzle retainer at 55.

While particular embodiments have been shown and described, it will be obvious to those skilled in the art that various changes and modification may be made without departing from the essential aspects of the invention and, therefore, the aim in the appended claims is to cover all such changes and modifications as fall within the true spirit and scope of the invention.

I claim:

1. A solely water pressure operated beverage dispenser unit designed for operative positioning and resting on a shelf, countertop and the like, and including, in combination, a rectangular enclosure cabinet, a plurality of hydraulic pumps mounted to and within said cabinet, each of said pumps having a driving liquid inlet and outlet and a pumped liquid inlet and outlet, a pressure regulator provided within said cabinet and including a pressured water inlet and also a pressure-regulated water outlet coupled to each of said driving liquid inlets of said pumps, a series of beverage conduits, passing through said cabinet and constructed for connection to a respective external primary beverage supplies, respectively coupled to said pumped liquid inlets of each of said pumps, a manifold mounted to and within said cabinet and having a series of inlets respectively coupled to said driving liquid outlets and said pumped liquid outlets of said pumps, an outlet flex hose coupled to said manifold, a nozzle retainer mounted to said cabinet and provided with a nozzle-receiving aperture, a single manually actuatable dispenser coupled to said flex hose and including an outlet beverage nozzle releasably seated in said nozzle retainer at said nozzle-receiving aperture, and a lid releasably secured to and over said cabinet whereby to complete the enclosure of said cabinet and cover said pumps and said manifold.

2. The structure of claim 1 wherein said cabinet is provided with access aperture means for admitting the passage therethrough of said beverage conduits.

3. The structure of claim 1 wherein said cabinet is provided with cut-outs for accommodating mounting of said nozzle retainer and said manifold within said cabinet and the exposure thereof to the exterior.

4. A solely water-pressure operated beverage dispenser unit designed for operative positioning and resting on a shelf, countertop and the like, and including, in combination, an enclosure member; at least one water-pressure driven first means mounted to and within said enclosure member for pumping at least one beverage ingredient to delivery structure; delivery structure secured to and within and extending beyond said enclosure member and coupled to said first means, said delivery structure including a manifold, a single hand-operated dispenser, and a flex hose coupled to and between said manifold and said dispenser; second means constructed for coupling to an external water-pressure source for driving said first means and also for supplying water to said manifold, and third means for supplying at least one beverage ingredient coupled to said first means.

5. The structure of claim 4 wherein said enclosure member is provided with a lid and also with an externally accessible nozzle retainer mounted to said enclosure member, said dispenser including a beverage outlet nozzle releasably supported by said nozzle retainer.

* * * * *